United States Patent [19]

Murray

[11] 4,357,118

[45] Nov. 2, 1982

[54] CONNECTING ASSEMBLY FOR GEODESIC DOME FRAMEWORK CONSTRUCTION

[76] Inventor: John R. Murray, 12142 E. 214th St., Hawaiian Gardens, Calif. 90716

[21] Appl. No.: 239,617

[22] Filed: Mar. 2, 1981

[51] Int. Cl.[3] ..... F16D 1/00; F16D 3/00

[52] U.S. Cl. ..... 403/172; 52/81; 403/176; 403/407; 403/218

[58] Field of Search ..... 52/81; 403/172, 176, 403/217, 218, 231, 407, 406

[56] References Cited

U.S. PATENT DOCUMENTS

| | | | |
|---|---|---|---|
| 2,682,235 | 6/1954 | Fuller | 108/1 |
| 3,486,278 | 12/1969 | Woods | 403/172 X |
| 3,635,509 | 1/1972 | Birkemeier | 52/81 X |
| 3,915,101 | 10/1975 | Onori | 403/217 X |
| 3,990,195 | 11/1976 | Gunther | 403/75 |
| 4,094,417 | 6/1978 | Cairnes et al. | 403/175 X |
| 4,245,809 | 1/1981 | Jackson | 52/81 X |
| 4,260,276 | 4/1981 | Phillips | 403/406 X |
| 4,262,461 | 4/1981 | Johnson et al. | 403/172 X |

FOREIGN PATENT DOCUMENTS

| | | | |
|---|---|---|---|
| 841351 | 6/1952 | Fed. Rep. of Germany | 403/218 |
| 2421920 | 11/1975 | Fed. Rep. of Germany | 52/81 |
| 1204327 | 9/1970 | United Kingdom | 403/217 |

OTHER PUBLICATIONS

Robert W. Marks, "The Dynamaxion World of Bluckmister" Fuller, Southern Illinois Press, 1960

Harlen Metal Products Inc., Compton, Ca. 90220.

*Primary Examiner*—Wayne L. Shedd

*Attorney, Agent, or Firm*—Howard A. Kenyon

[57] ABSTRACT

A connecting assembly consisting of a hub and a plurality of U shaped connecting members for joining the framework of geodesic domes is provided. The hub is formed from a hollow member containing a plurality of radial grooves designed to accept the rectangular end of framing members. The rectangular ends are secured in the grooves by the U shaped connecting members that wrap around the bottom of the grooves of the internal side of the hub and thereafter lie adjacent to the flat end of the framing members. Further, nails, screws or bolts can be used to secure the U shape connecting members to the rectangular ends of the framing members. The frame members extend radially from the center of the hub and are so arranged that the angle between the adjacent framing members is at least 40°. The grooves are so designed that the attached framing members form an angle from 1° to 14° with a plane perpendicular to the central axis of the hub.

9 Claims, 4 Drawing Figures

FIG. 3
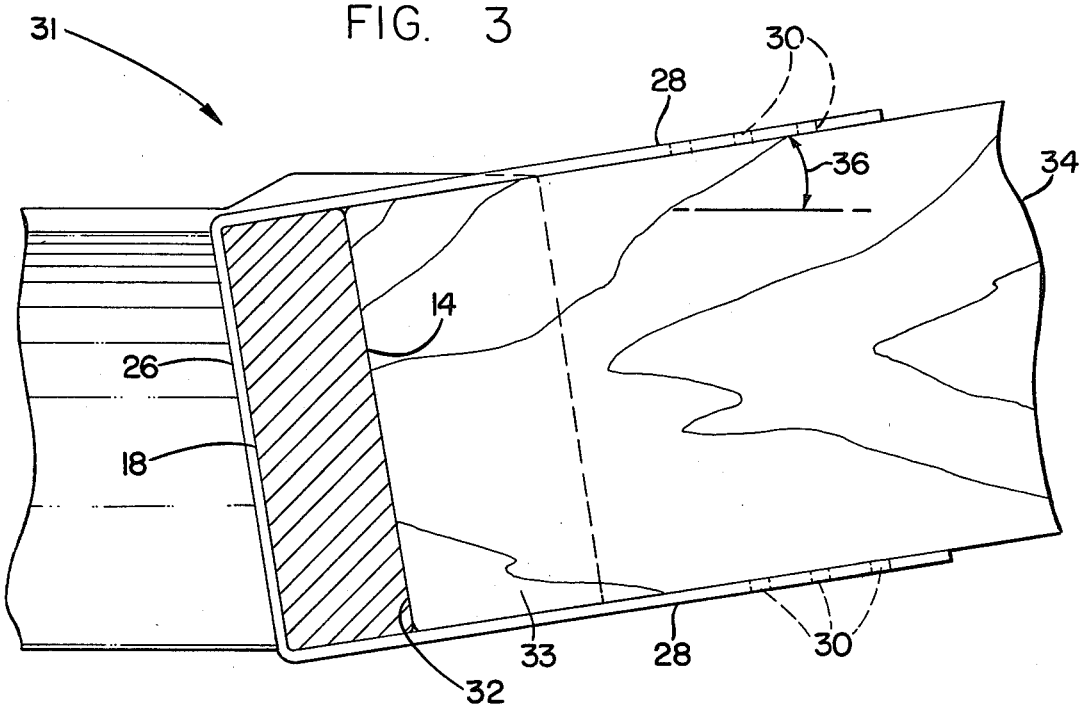
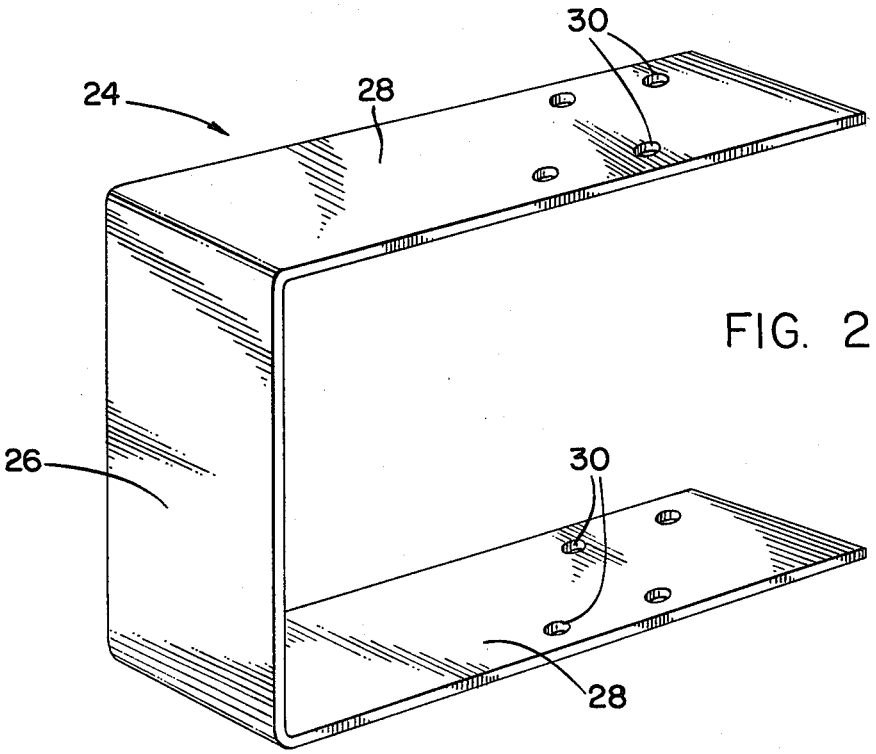
FIG. 2

CONNECTING ASSEMBLY FOR GEODESIC DOME FRAMEWORK CONSTRUCTION

BACKGROUND OF THE INVENTION

The present invention relates to a connecting assembly for joining the framework of a geodesic dome. More particularly, the invention is directed to a type of connecting assembly that is simple, easy for non-skilled persons to use and can utilize inexpensive connecting means to connect the hub to the framework.

Structures formed by geodesic domes have been utilized for years. These structures were first described by Fuller in U.S. Pat. No. 2,682,235. In addition, Robert W. Marks also described many geodesic dome structure constructions in a book entitled, "The Dynamaxion World of Buckmister Fuller," Southern Illinois University Press, 1960. One of the early described uses of geodesic domes was for greenhouses. Structures formed from geodesic domes have exceptional strength as well as low cost.

Previous hubs utilized in the construction of geodesic domes have required the framing members to be milled to fit onto the leg of a hub. One such hub is described in U.S. Pat. No. 3,990,195 to Gunther. This milling of the framing member substantially increases the cost of the structure. In addition, the only connecting means of the framing member to the hub in this patent is by bolts. Both of these limitations add to the cost of the structure and therefore renders the structure utilizing this type of hub less desirable.

SUMMARY OF THE INVENTION

It is therefore an object of the present invention to provide a connecting assembly for geodesic domes that will improve the assembly of geodesic structures.

It is another object of the present invention to provide a connecting assembly for geodesic domes that is simple and easy to assemble.

It is yet another object of the present invention to provide a connecting assembly for geodesic domes that is low cost.

Briefly, in accordance with the invention, there is provided a connecting assembly for geodesic domes consisting of a hub and a U shaped connecting member. The hub is hollow, made preferably from low cost castable material. The U shaped connecting members are preferably metal straps that fit around flat lands cast in the internal area of the hub, extending over the ends of the framing members and thereafter securely fastened.

Other objects and advantages of the invention will become apparent upon reading the following detailed description and upon reference to the drawings.

BRIEF DESCRIPTION OF THE DRAWINGS

FIG. 2 is a perspective view of a U-shaped connecting member.

FIG. 3 is a sectional view of the hub across line 3—3 of FIG. 1 also showing a side view of U shaped connecting member and a side view of a framing member end.

While the invention will be described in connection with the preferred embodiments, it will be understood that it is not intended to limit the invention to those embodiments. On the contrary, it is intended to cover all alternatives, modifications, and equivalents that may be included within the spirit and scope of the invention as described by the appended claims.

DETAILED DESCRIPTION OF THE INVENTION

Figure 1:
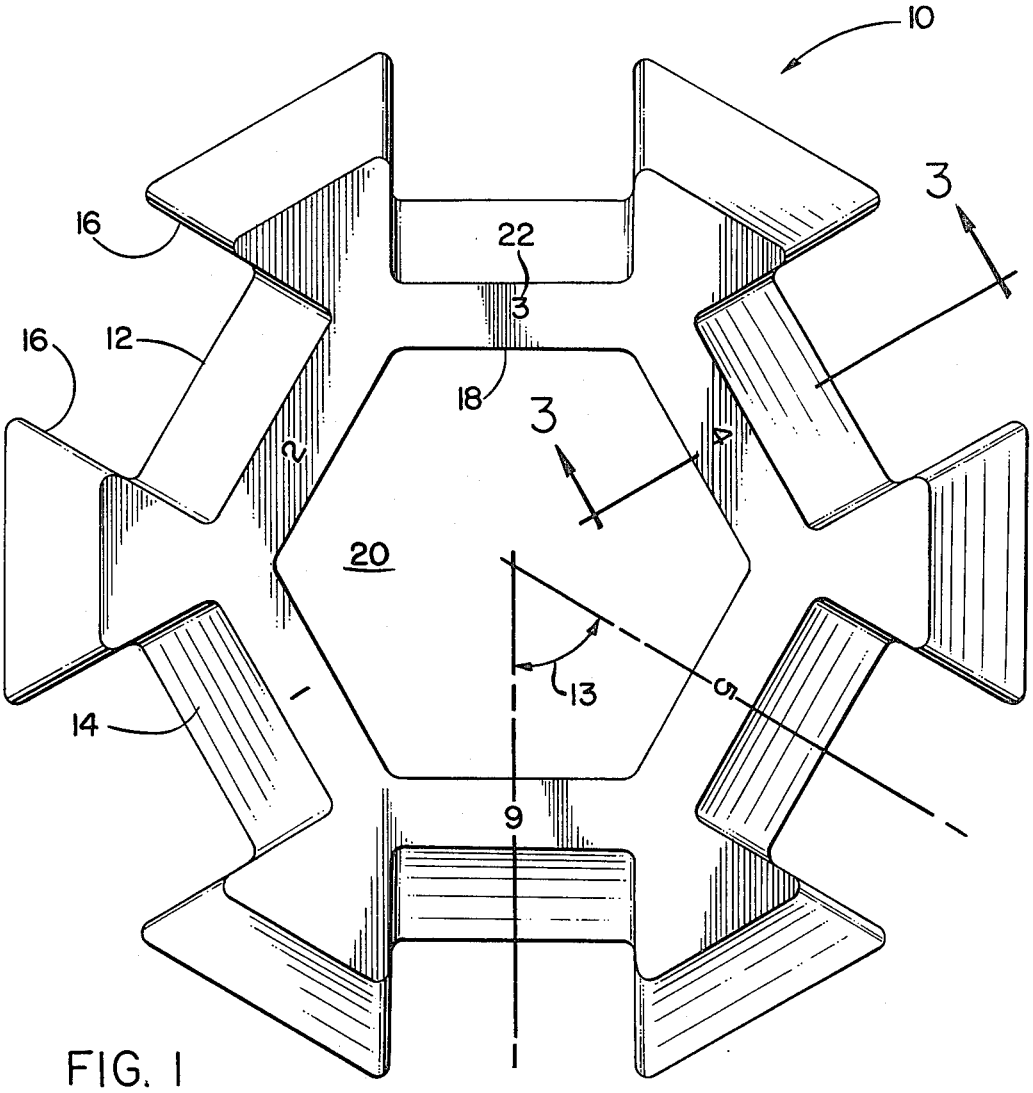
FIG. 1 is a plan view of the hub of the present invention showing the hollow internal center and the grooves that accept the ends of the framing members.

Referring now to FIG. 1, there is shown according to the present invention, a hub generally indicated at 10. The hub 10 as shown in FIG. 1 is comprised of grooves 12 and equal angles 13. The hub 10 of FIG. 1 showing six grooves 12 is the embodiment most preferred in the present invention as a hub 10 in the construction of geodesic domes (not shown). A hub 10 may contain three or more grooves 12 which will be used in specific places on a geodesic structure (not shown). For example, a hub containing three or four grooves is used in geodesic domes around an entryway or a protuberance such as a bay window of a geodesic structure. The angles 13 between the grooves 12 of the hub 10 when used in fabricating an entryway or protuberance of a geodesic structure are not equal and must be carefully selected to provide the proper geodesic structure. The flat bottom 14 of the groove 12 and the sides 16 of the groove 12 of the hub 10 are substantially perpendicular to each other which will hold snugly the end of a framing member (to be described later). Flat lands 18 are formed in the hollow hub center 20 that are parallel to the flat bottom 14. A marking number 22 is imprinted into hub 10 to assist in assembly of the geodesic dome. A color code (not shown) could also be used as an alternative in lieu of marking number 22 to assist in assembly. A corresponding number or color would also be imposed on the rectangular end (to be described later) of a framing member. In the preferred embodiment, the hub 10 would be made of low cost castable material.

With reference to FIG. 2, generally indicated as 24, there is shown the preferred embodiment of a U shaped connecting member. This U shaped connecting member 24 is generally a thin flat metal strap with a plurality of holes through the parallel sides 28. One such metal connecting member is manufactured by Harlen Metal Products Company and can be obtained to fit either rough or nominal lumber. The flat bottom piece 26 of connecting member 24 is designed to mate with the flat land 18 of hub 10. The parallel sides 28 of connecting member 24 are designed to lie adjacent to the rectangular end of a framing member. The holes 30 in sides 28 of connecting member 24 are to be utilized to join the rectangular end of framing member to the parallel sides 28 by some connecting means.

Referring now to FIG. 3, generally shown as 31, there is shown a cross section of hub 10 between the flat bottom 14 of groove 12 and internal flat land 18. A cross section of framing member 34 and U shaped connecting member 24 as placed in groove 12 is also shown in FIG. 3. It can also be seen that the flat bottom 14 of groove 12 is parallel to the internal flat land 18. The butt end 32 of the rectangular end 33 of framing member 34 fits snugly against the flat bottom 14 of groove 12. The angle 36 can vary from 1° to 14° depending on the size and configuration of the geodesic structure. The connecting member 24 is shown wrapped around a portion of the hub 10 such that the flat bottom piece 26 of connecting member 24 fits snugly with flat land 18 of hub 10. The rectangular end 33 of framing member 34 also fits snugly with the flat bottom 14 of groove 12 in hub 10. Connecting means (not shown) fasten the parallel sides 28 of connecting member 24 tightly to framing member 34 through holes 30. One such connecting means that would provide simplicity and low cost would be common nails (not shown). If the framing member 34 is made of wood. The structural loads imposed on the framing member 34 are thereby transferred to hub 10 by the connecting member 24.

Figure 4:
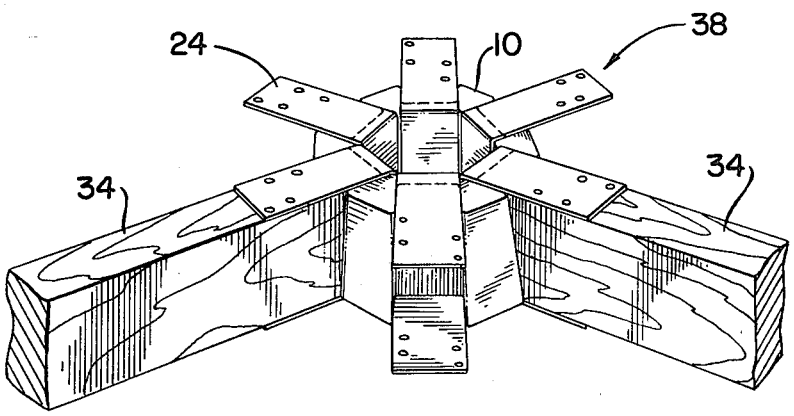
FIG. 4 is a perspective view showing the hub, the U shaped connecting members and a framing member connected thereto.

Referring now to FIG. 4 generally shown as 38 there is shown a complete hub 10 and framing members 34 attached to the connecting members 24 to provide a simple, inexpensive, load carrying connecting assembly for geodesic dome framework construction.

Thus it is apparent that there has been provided, in accordance with the invention, a connecting assembly for joining the framework of geodesic domes that fully satisfies the objectives, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications, and variations which fall within the spirit and scope of the appended claims.

What is claimed is:

1. A connecting assembly for joining the the framework of a geodesic dome comprising:

(a) a hub, having at least three grooves, said grooves having two flat substantially parallel sides and a flat bottom substantially perpendicular to said flat substantially parallel sides, said grooves facing radially outward from the center of said hub, said hub having a hollow center with flat internal lands in said hollow center, said flat internal lands being substantially parallel to said flat bottom of said groove, (b) A U-shaped connecting member having two parallel sides and a flat bottom piece.

2. A connecting assembly of claim 1 wherein said grooves in said hub are sized to receive the rectangular end of a framing member.

3. A connecting assembly of claim 2 wherein said grooves and said rectangular ends of said framing member are numbered or color coded correspondingly, and the flat butt end of said rectangular framing member communicates with said flat bottom of said groove.

4. A connecting assembly of claim 1 wherein said hub is connected to said rectangular end of said framing member by said U shaped connecting member.

5. A connecting assembly of claim 4 wherein said flat bottom piece of said U shaped connecting member communicates with said flat internal land of said hub whereby said two parallel sides of said U shaped connecting member lies adjacent to and extends past said rectangular end of said framing member.

6. A connecting assembly of claim 5 whereby said U shaped connecting member is a thin flat metal strap with a plurality of holes through said parallel sides.

7. A connecting assembly of claim 6 wherein said two parallel sides of said U shaped connecting member is joined by a connecting means to said rectangular end of said framing member.

8. A connecting assembly of claim 1 wherein the angle between said framing members after being connected to said hub by said connecting means is at least 40°.

9. A connecting assembly of claim 1 wherein said framing member after being connected to said hub forms an angle from 1° to 14° with a plane perpendicular to a central axis of said hub.

* * * * *